US007444846B2

(12) United States Patent
Stewart

(10) Patent No.: US 7,444,846 B2
(45) Date of Patent: Nov. 4, 2008

(54) DRILL RESISTANT LOCK CYLINDER

(75) Inventor: James Stewart, Scarborough (AU)

(73) Assignee: Donald Charles Stewart (AU)

( * ) Notice: Subject to any disclaimer, the term of this patent is extended or adjusted under 35 U.S.C. 154(b) by 126 days.

(21) Appl. No.: 11/661,844

(22) PCT Filed: Sep. 2, 2005

(86) PCT No.: PCT/AU2005/001340

§ 371 (c)(1),
(2), (4) Date: Mar. 5, 2007

(87) PCT Pub. No.: WO2006/026809

PCT Pub. Date: Mar. 16, 2006

(65) Prior Publication Data

US 2008/0078221 A1 Apr. 3, 2008

(30) Foreign Application Priority Data

Sep. 6, 2004 (AU) ..... 2004905059

(51) Int. Cl.
*E05B 27/08* (2006.01)

(52) U.S. Cl. ..... 70/491; 70/403; 70/417; 70/419

(58) Field of Classification Search ..... 70/190, 70/DIG. 21, DIG. 9, 409–412, 491, 496, 70/403, 404, 417, 419, DIG. 60, DIG. 22, 70/DIG. 37, DIG. 71, 380; 292/142
See application file for complete search history.

(56) References Cited

U.S. PATENT DOCUMENTS 1,409,094 A * 3/1922 Greenison ..... 70/134
2,015,735 A * 10/1935 Thomalla ..... 70/467
2,090,114 A * 8/1937 Deutsch ..... 70/411
2,993,361 A * 7/1961 Van Lahr ..... 70/491
3,380,268 A * 4/1968 Perrill ..... 70/491
4,099,396 A 7/1978 Kerr
4,653,297 A * 3/1987 Moorhouse ..... 70/491
4,735,069 A * 4/1988 Steinbach ..... 70/491
4,802,354 A * 2/1989 Johnson ..... 70/491
4,858,456 A * 8/1989 McGee, Sr. ..... 70/491
5,018,376 A * 5/1991 Lee ..... 70/491
2002/0116968 A1 8/2002 Shvarts
2003/0154752 A1 8/2003 Price
2004/0003634 A1* 1/2004 Keller ..... 70/380
2005/0217329 A1* 10/2005 Chang ..... 70/417
2007/0033975 A1* 2/2007 Liu ..... 70/491

FOREIGN PATENT DOCUMENTS

CA 1 048 288 2/1979

* cited by examiner

*Primary Examiner*—Lloyd A Gall
(74) *Attorney, Agent, or Firm*—The Farrell Law Firm, P.C.

(57) ABSTRACT

A drill resistant lock cylinder is useful for resisting attempts to defeat the cylinder using locks or picks. The cylinder includes a cylinder housing (105) having a central axis. Two pinion cylinders (115, 125) are positioned inside the cylinder housing (105) along the central axis. A combination pin cylinder (120) is positioned along the central axis between the two pinion cylinders (115, 125), and the combination pin cylinder (120) and each pinion cylinder (115, 125) includes axial pinholes (220) there through. Pins (130) located inside the axial pinholes (220) in the combination pin cylinder (120) and the pinion cylinders (115, 125) establish two shear lines along axial ends of the pinion cylinders (115, 125).

8 Claims, 5 Drawing Sheets

DRILL RESISTANT LOCK CYLINDER

The present invention relates generally to an improved lock mechanism, and particularly to an improved lock cylinder that is resistant to attempts to defeat the lock cylinder using drills or picks.

BACKGROUND

Securing homes and businesses from unlawful intrusion and theft has been a major societal challenge for hundreds of years. The challenge continues today as security devices now represent a multi-billion dollar industry. The inventories of many booming security businesses include various sophisticated door and window locks. As with many efforts to defeat criminal activity, law-abiding citizens who attempt to secure their homes and businesses are forced to stay a step ahead of the latest technological tools of criminals.

Sophisticated and strong locks such as dead bolts on doors and windows are often considered a necessity for adequately protecting premises. As thieves become more clever at picking and defeating such locks, lock manufacturers are driven by consumer demand to produce ever better and more sophisticated locks. Further many insurance companies now routinely provide discounts or reductions to customers who elect to use the latest technologies for securing valuables.

Movies and police television programs frequently display the latest techniques used by criminals to break through locks and alarm systems. As an example, the advent of the low-cost and compact cordless drill has been shown numerous times in police dramas as an effective method for quickly defeating many otherwise strong locks. Such wide media exposure teaches the vulnerabilities of such locks to millions of people. Thus most criminals are now aware that a hardened steel drill bit directed down a lock cylinder and powered by a cordless drill can stealthily and quickly sheer off the pins of many conventional locks, rendering the lock easily opened.

Existing anti-drill features included on locks are often inadequate. For example anti-drill discs installed on the front face of some conventional lock cylinders are designed to spin when a drill bit is placed against the disc. However the discs often can be defeated by large high-speed bits that cause the discs to lock in place and then be drilled through.

Other anti-drill lock features are usable only on a single lock face, and are therefore not practical for implementation on dead-bolt locks that include two key access points, one on either side of a door or window.

Therefore there is a need for an improved lock cylinder, which can be applied to various types of locks, and which includes anti-drill features that are highly effective against drilling and that are also practical for use in dead bolt locks having key access from two sides.

OBJECTS OF THE INVENTION

An object of the present invention is to solve one or more problems of locking mechanisms that are vulnerable to defeat by drilling or picking of a lock cylinder as described in the background section.

A further object of the invention is to provide a useful alternative to the known prior art.

SUMMARY OF THE INVENTION

In one form, although it need not be the only or indeed the broadest form, the invention resides in a drill resistant lock cylinder comprising: a cylinder housing having a central axis;

two pinion cylinders positioned inside the cylinder housing along the central axis; a combination pin cylinder positioned along the central axis between the two pinion cylinders, wherein the combination pin cylinder and each pinion cylinder includes axial pinholes there through; and pins located inside the axial holes in the combination pin cylinder and the pinion cylinders; whereby two shear lines are established along axial ends of the pinion cylinders.

Some of the pins may be of variable lengths, enabling a key having pins of corresponding variable lengths to be inserted at an axial end of the housing, causing the pins to align along the two shear lines, whereby the cylinder is placed in an unlocked configuration.

The cylinder may also include an anti-drill disc at one end of the cylinder housing to discourage drilling of the housing.

The pinion cylinders may include opposing pinion teeth designed to engage a rack for sliding a bolt in and out of a locked position.

The axial pinholes may be positioned equidistant from each other at a constant radius from the central axis of the housing, thereby enabling the cylinder to be locked in a plurality of rotational positions.

The cylinder may include a detachable key that can be secured to the cylinder for safety purposes.

The detachable key may include key combination discs of varying thicknesses for changing the mechanical combination required to unlock a lock cylinder.

Further features and advantages of the present invention will be apparent to those skilled in the art based on the following detailed description.

BRIEF DESCRIPTION OF THE DRAWINGS

In order that the invention may be readily understood and put into practical effect, reference will now be made to preferred embodiments as illustrated with reference to the accompanying drawings, wherein like reference numbers refer to like elements, in which.

DETAILED DESCRIPTION OF THE PREFERRED EMBODIMENTS

Figure 1:
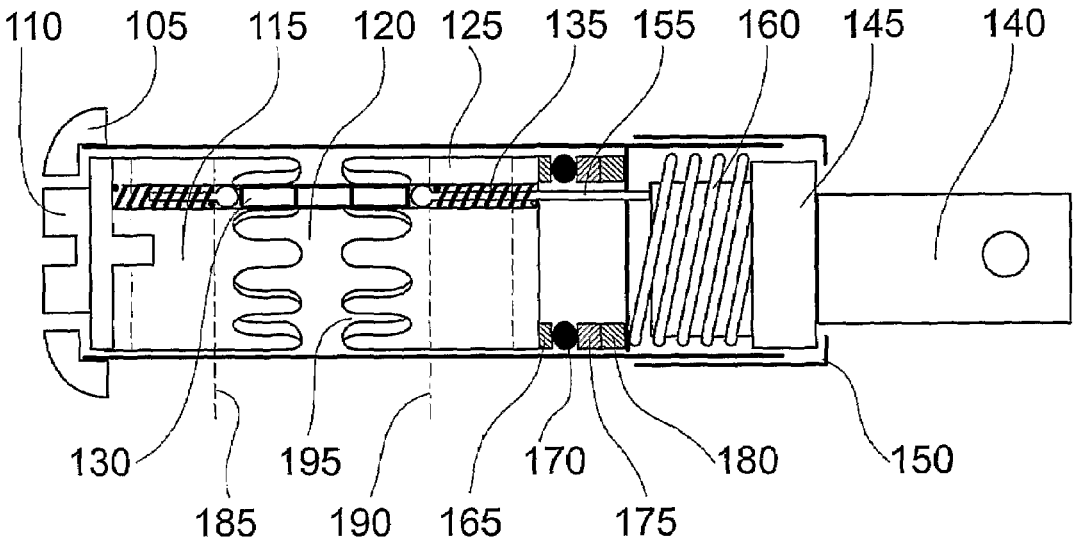
FIG. 1 is a schematic diagram illustrating a partial cross-sectional view of a dead-bolt lock cylinder.

Embodiments of the present invention reside primarily in combinations of apparatus components related to a drill resistant lock cylinder. Accordingly, the apparatus components have been illustrated in concise schematic form in the drawings, showing only those specific details that are necessary to understanding the embodiments of the present invention, but so as not to obscure the disclosure with excessive detail that will be readily apparent to those of ordinary skill in the art having the benefit of the present description.

In this specification, adjectives such as first and second, left and right, top and bottom, and the like may be used solely to distinguish one element or action from another element or action without necessarily requiring or implying any actual such relationship or order. Words such as "comprises" or "includes" are intended to define a non-exclusive inclusion, such that a process, method, article, or apparatus that comprises a list of elements does not include only those elements but may include other elements not expressly listed, including elements that are inherent to such a process, method, article, or apparatus.

Referring to FIG. 1 there is a schematic diagram illustrating a partial cross-sectional view of a dead-bolt lock cylinder according to a preferred embodiment of the present invention. The cylinder includes a cylinder housing 105 having a central axis, an anti-drill disc 110, an outer pinion cylinder 115, a combination pin cylinder 120, an inner pinion cylinder 125, constant length combination pins 130, variable length combination pins 135, an inside detachable key 140, a key collar 145, a key nut 150, key combination pins 155, a compression spring 160, a washer 165, a pressure ring 170, a first locking ring 175, and a second locking ring 180.

The anti-drill disc 110 is designed to spin in the housing 105 should any attempt be made to drill out the entire cylinder with a relatively large bore drill. In such an event a drill bit would bind on the anti-drill disc 110, stopping the bit from drilling into the cylinder. The constant length combination pins 130 are designed to lock the outer and inner pinion cylinders 115, 125, which are positioned along the central axis of the housing 105, to the combination pin cylinder 120 when the pins 130 are positioned across an outer shear line 185 and an inner shear line 190. The variable length combination pins 135 are located inside the pinion cylinders 115, 125 and are used to position the constant length combination pins 130 in either a locked or an unlocked configuration, depending on whether axial force is applied to an end of each variable length combination pin 135 by the key combination pins 155. According to other embodiments of the present invention, ends of the variable length combination pins 135 that are impacted by the key combination pins 155 can be hollowed out to provide a false sounding if attempts are made to pick a cylinder using picks that have a diameter smaller than the diameter of the key combination pins 155.

When the constant length combination pins 130 are positioned to create a gap along both shear lines 185, 190 both between the outer pinion cylinder 115 and the combination pin cylinder 120, and between the inner pinion cylinder 125 and the combination pin cylinder 120, then the inner and outer pinion cylinders 115, 125 are able to rotate, thus causing movement of the pinion teeth 195.

The key combination pins 155 are secured in an end of the detachable key 140. The detachable key 140 may then be threaded onto the cylinder using the key nut 150 that engages the key collar 145.

The washer 165 is used to alleviate friction between the inner pinion cylinder 125 and the pressure ring 170. The first locking ring 175 is used to apply pressure to the pressure ring 170 so as to maintain relatively constant pressure between the combination pin cylinder 120 and the inner and outer pinion cylinders 115, 125. The second locking ring 180 is used to secure the first locking ring 175 in a fixed position.

Figure 2A:
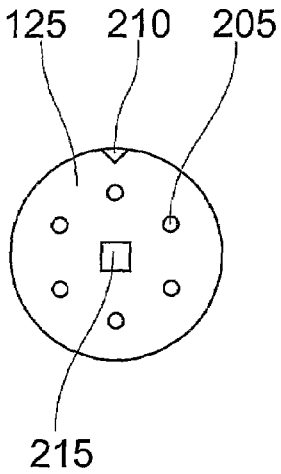
FIGS. 2A-2C are schematic diagrams illustrating a first end view, a second end view, and a side view, respectively, of an inner pinion cylinder.
Figure 2B:
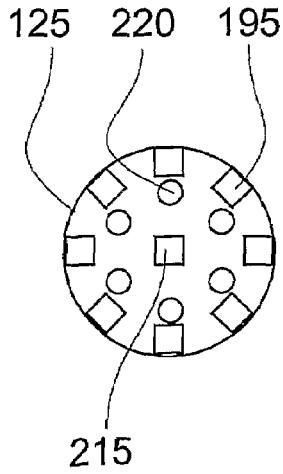
Figure 2C:
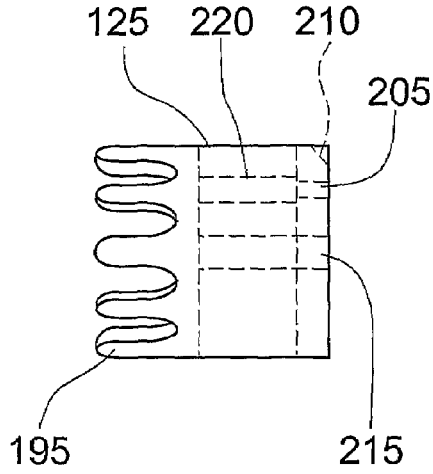

Referring to FIGS. 2A-2C there are schematic diagrams illustrating a first end view (FIG. 2A), a second end view (FIG. 2B) and a side view (FIG. 2C) of the inner pinion cylinder 125. FIG. 2A shows six axial micro pinholes 205 through which slide the key combination pins 155. Also shown is a notch 210 used to align the micro pinholes 205 during assembly of the lock cylinder. A square hole 215 is used to secure the inner and outer pinion cylinders 115, 125 in a fixed rotational relationship. FIG. 2B shows pinion teeth 195 and six axial combination pinholes 220 through which slide the variable length combination pins 135, the constant length combination pins 130, and the key combination pins 155. The combination pinholes 220 are generally of a larger diameter than the diameter of the micro pinholes 205. Both the combination pinholes 220 and the micro pinholes 205 are preferably located equidistant from each other and at a constant radius from the centres of the cylinders 115, 120, 125, thus enabling the cylinder to be locked in numerous rotational positions, as described further below. FIG. 2C is a more detailed side view of the inner pinion cylinder 125.

Those skilled in the art will appreciate the innovative features of the present invention described above. In particular the outer and inner shear lines 185, 190 provide additional locking security to the cylinder while simultaneously enabling the cylinder to be unlocked using either the inside detachable key 140 or an outside key (not shown). Further, the anti-drill disc 110 and the variable length combination pins 135 provide dual protection against attempts to defeat the lock through drilling. As discussed above, the anti-drill disc 110 is a deterrent to relatively large bore drill bits that would seek to drill out the entire lock cylinder. Similarly the variable length combination pins 135 are a deterrent to relatively smaller bore drill bits that would seek to drill out each combination pinhole 220. Such a small bore drill bit placed against an outer end of a variable length combination pin 135 causes the pin 135 to simply rotate in its respective combination pinhole 220, and thus no drilling progress can be made.

The relatively small diameters of the micro pinholes 205 compared to the combination pinholes 220 also make the cylinder less vulnerable to picking, as only very fine tools are able to access the variable length combination pins 135 through the micro pinholes 205. Similar micro pinholes 205 are present (but not shown in the drawings) on the anti-drill disc 110 to enable the lock cylinder to be operated from the outside by an outside key. Such an outside key is preferably similar to the inside detachable key 140, but the collar 145 is unnecessary as generally an outside key does not require means for securing it to the cylinder, as does an inside key for purposes of fire safety. Note also that the variable length combination pins 135 inside both pinion cylinders 115, 125 can be designed so that the detachable key 140 will unlock the cylinder 100 from either the inside or the outside.

Figure 3A:
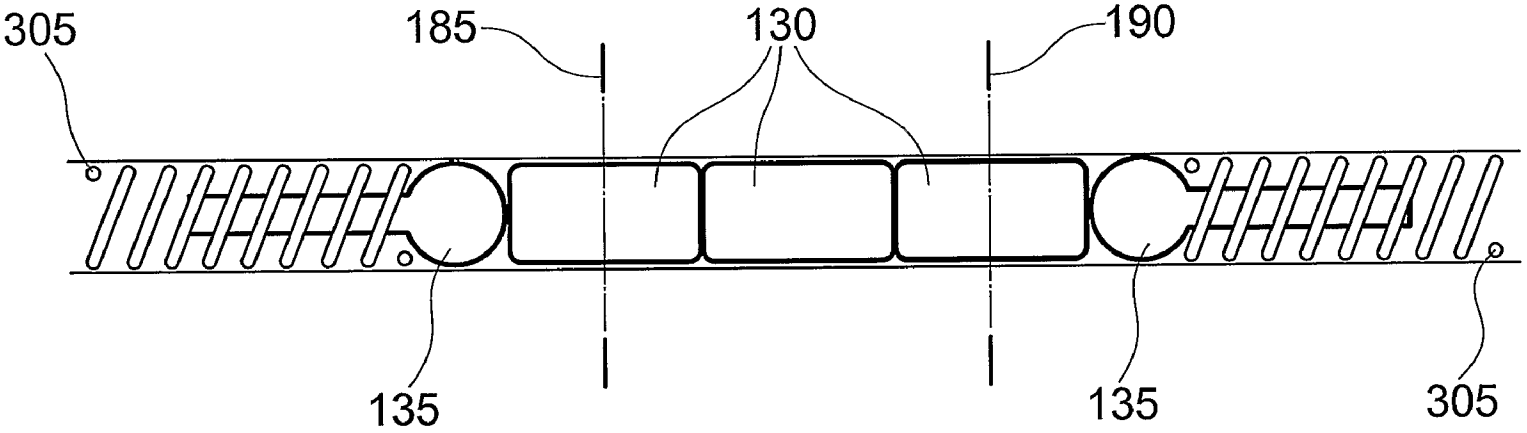
FIG. 3A is a schematic diagram illustrating a close up side view of a single combination pinhole including pins in a locked configuration.

Referring now to FIG. 3A, there is a schematic diagram illustrating a close up side view of a single combination pinhole 220 including variable length combination pins 135 and constant length combination pins 130 in a locked configuration. The configuration is locked because the constant length combination pins 130 cross the shear lines 185, 190, thus preventing rotation of the inner and outer pinion cylinders 115, 125 relative to the combination pin cylinder 120.

The combination pin cylinder 120 is fixed to the lock cylinder 100 (as described below), thus the locked configuration shown in FIG. 3A prevents any gross motion of the pinion cylinders 115, 125. The locked configuration is maintained by the equal and opposing forces from two retaining springs 305, one spring 305 located in each pinhole 220 of each pinion cylinder 115, 125. Such a locked configuration is therefore maintained when no key is inserted in either an outside or an inside end of the lock cylinder.

Figure 3B:
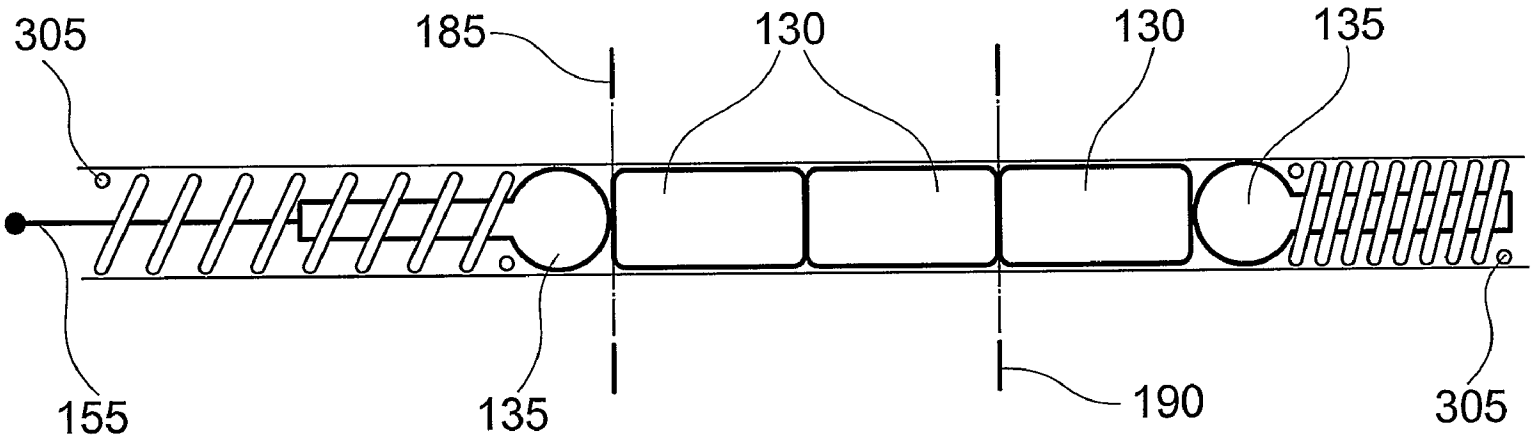
FIG. 3B is a schematic diagram illustrating a close up side view of a single combination pinhole including pins in an unlocked configuration.

Referring to FIG. 3B, there is a schematic diagram illustrating a close up side view of a single combination pinhole 220 including variable length combination pins 135 and constant length combination pins 130 in an unlocked configuration. Here, a key combination pin 155 presses against the left hand variable length combination pin 135, which in turn slides the constant length combination pins 130 to the right until ends of the pins 130 align with the shear lines 185, 190. The inner and outer pinion cylinders 115, 125 are then free to rotate relative to the combination pin cylinder 120 and to the lock cylinder 100. Note that when the pins 130 are maintained in such an unlocked configuration the right hand retaining spring 305 is compressed, so that when the key combination pin 155 is removed the right hand retaining spring 305 forces the pins 130 back to the left until equilibrium is again reached at the locked configuration shown in FIG. 3A. Note also that the variable length combination pins 135 are used to both improve the anti-drill and anti-pick features of the present invention as well as reduce the required length of the key combination pins 155.

Figure 4:
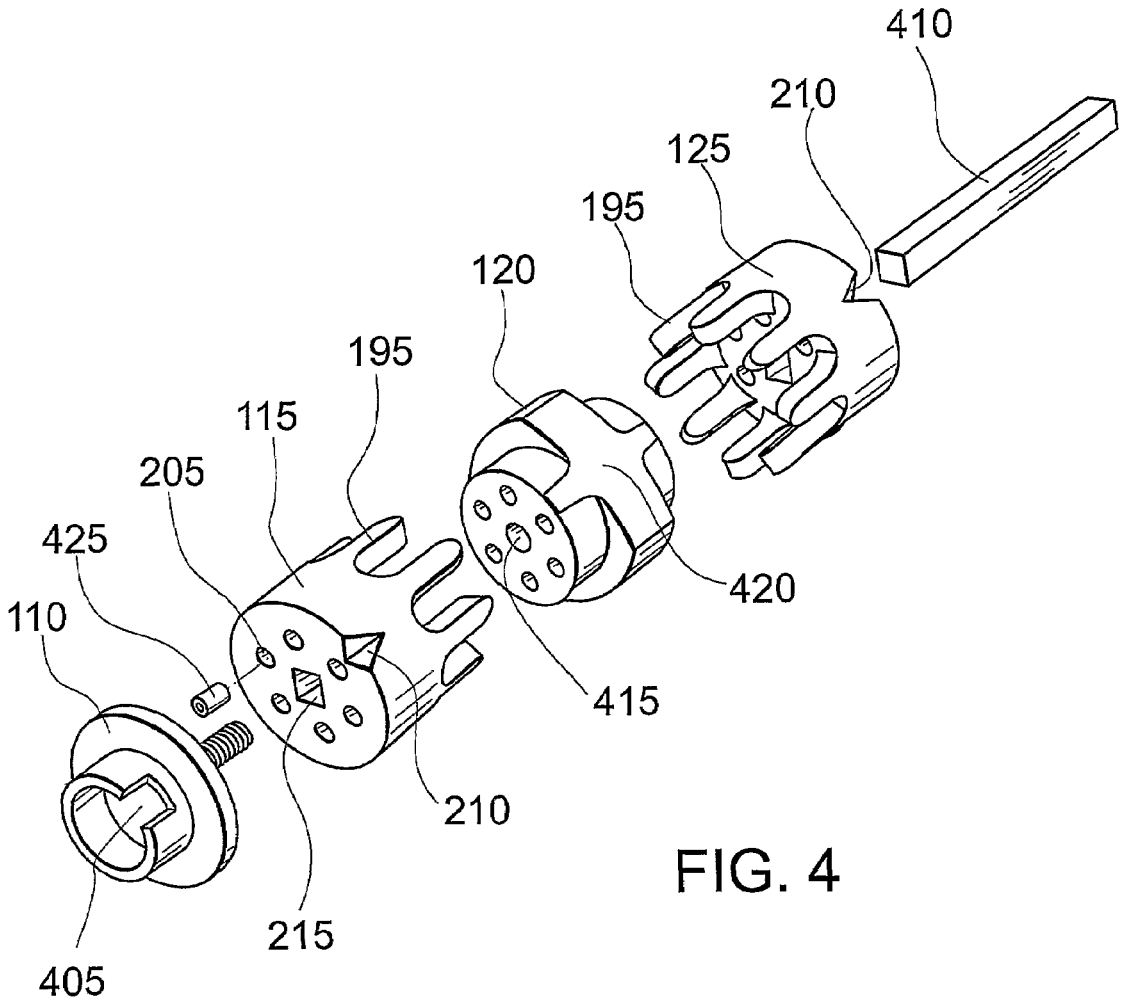
FIG. 4 is a schematic diagram illustrating an exploded perspective view of components of a lock cylinder.

Referring to FIG. 4 there is a schematic diagram illustrating an exploded perspective view of some components of the lock cylinder including additional elements and features. A location slot 405 in the anti-drill disc 110 is used to ensure correct alignment of key combination pins 155 and the outer pinion cylinder 115. Also, a square central shaft 410 is shown that is used to lock the inner and outer pinion cylinders 115, 125 together in a fixed rotational relationship using the square holes 215 in the inner and outer pinion cylinders 115, 125. Note that a hole 415 in the combination pin cylinder 120 enables the combination pin cylinder 120 to rotate relative to the shaft 410. A flat 420 on the cylinder 120 ensures that a rack-end of a dead-bolt 610 (see FIG. 6) does not impact the cylinder 120. Also illustrated is a hollow plug 425, one of which is inserted into each micro pinhole 205, which enables combination pins 130, 135 and retaining springs 305 to be loaded into the micro pinholes 205 during assembly of the cylinder but help retain the springs 305 during use of the cylinder. The hollow plugs 425 also protect the retaining springs 305 in the event the anti-drill disc 110 turns relative to the outer pinion cylinder 115.

Figure 5A:
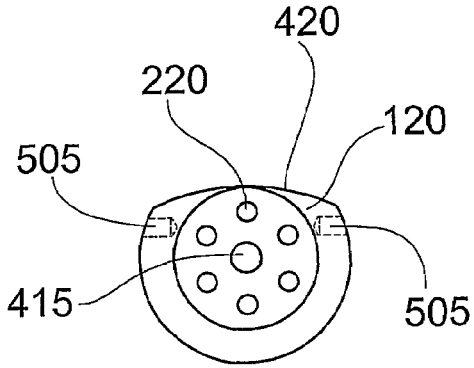
FIG. 5A is a schematic diagram illustrating an end view of a combination pin cylinder.
Figure 5B:
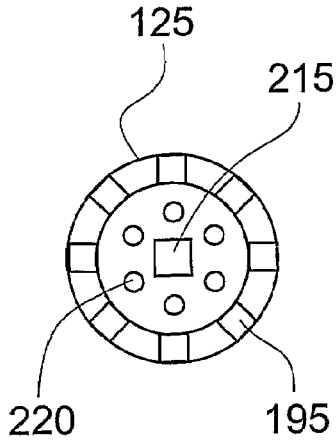
FIG. 5B is a schematic diagram illustrating an end view of an inner pinion cylinder.

Referring to FIG. 5A there is a schematic diagram illustrating an end view of the combination pin cylinder 120. Threaded holes 505 are included in the cylinder 120 to assist in securing the cylinder 120 to the housing 105, which may be accomplished using set screw 655 (see FIG. 6) threaded through the housing 105 and into the hole 505. Referring to FIG. 5B there is a schematic diagram illustrating a further end view of the inner pinion cylinder 125, for the purpose of showing the relative diameters of the pinion cylinder 125 and the combination pin cylinder 120 shown in FIG. 5A. FIG. 5B also illustrates that the pinion teeth on the pinion cylinders 115, 125 overlap the combination pin cylinder 120.

The above described lock cylinder according to a specific embodiment of the present invention therefore may be used to lock any of various types of enclosures such as doors and windows. Those skilled in the art will appreciate however that the present invention is adaptable for use with any type of locking mechanism that is engageable with the pinion teeth 195 of the inner and outer pinion cylinders 115, 125. One specific example of a standard dead-bolt lock for a door is described below.

Figure 6:
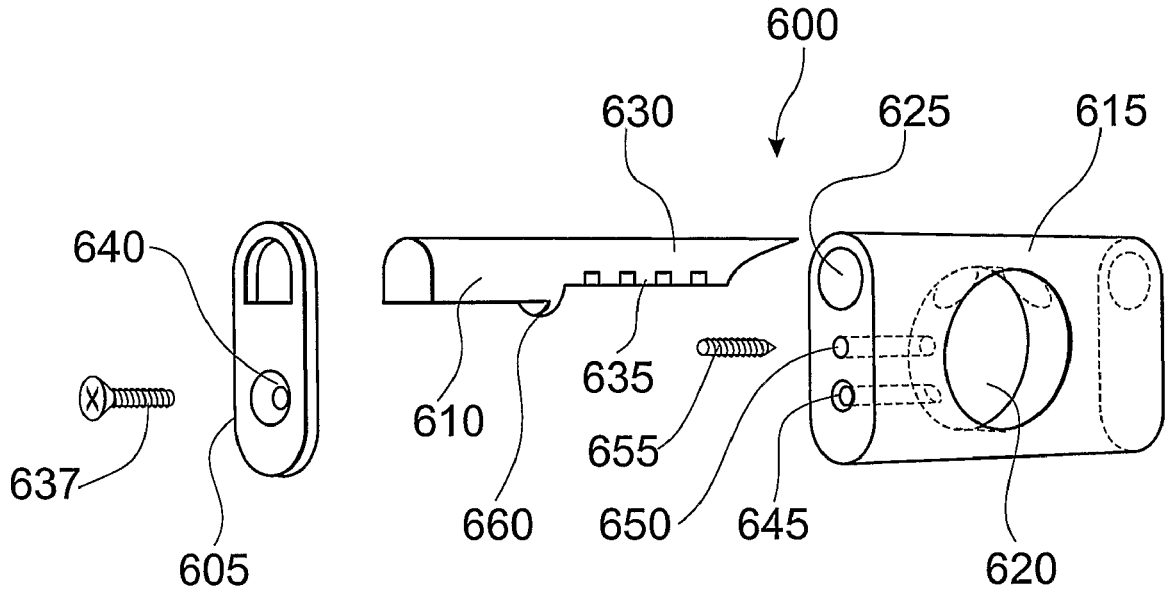
FIG. 6 is a schematic diagram illustrating an exploded perspective view of a dead-bolt housing assembly.

Referring to FIG. 6, there is a schematic diagram illustrating an exploded perspective view of a dead-bolt housing assembly 600. The assembly 600 includes a retaining plate 605, a dead-bolt 610, and a bolt housing 615. The housing 615 includes a large cylinder hole 620 for receiving the lock cylinder. The housing 615 further includes a smaller bolthole 625 for receiving the dead-bolt 610.

The dead-bolt 610 includes a rack end 630 that includes rack teeth 635. When the dead-bolt housing assembly 600 and the lock cylinder are assembled together, the cylinder is positioned orthogonal to the housing 615 and the housing 615 is located along the central axis of the cylinder such that the pinion teeth 195 of the inner and outer pinion cylinders 115, 125 mesh with the rack teeth 635 of the dead-bolt 610. Rotational movement of the inner and outer pinion cylinders 115, 125 relative to the housing 615 thereby causes translational movement of the dead-bolt 610 along the central axis of the bolthole 625.

The retaining plate 605 is used to prevent the bolt 610 from moving too far out of the housing 615 during operation of the lock cylinder. In the event that the dead-bolt 610 is overextended out of the housing 615, shoulder 660 contacts the retaining plate 605. The retaining plate 605 is secured to the housing 615 by a screw 637 placed through hole 640 and threaded into hole 645. Hole 650 in the housing 615 receives set screw 655 that is threaded through the cylinder housing 105 and into one of the holes 505 of the combination pin cylinder 120 (depending on the orientation of the cylinder 120 relative to the housing assembly 600), thereby rigidly connecting together the cylinder housing 105, bolt housing 615 and combination pin cylinder 120.

Figure 7A:
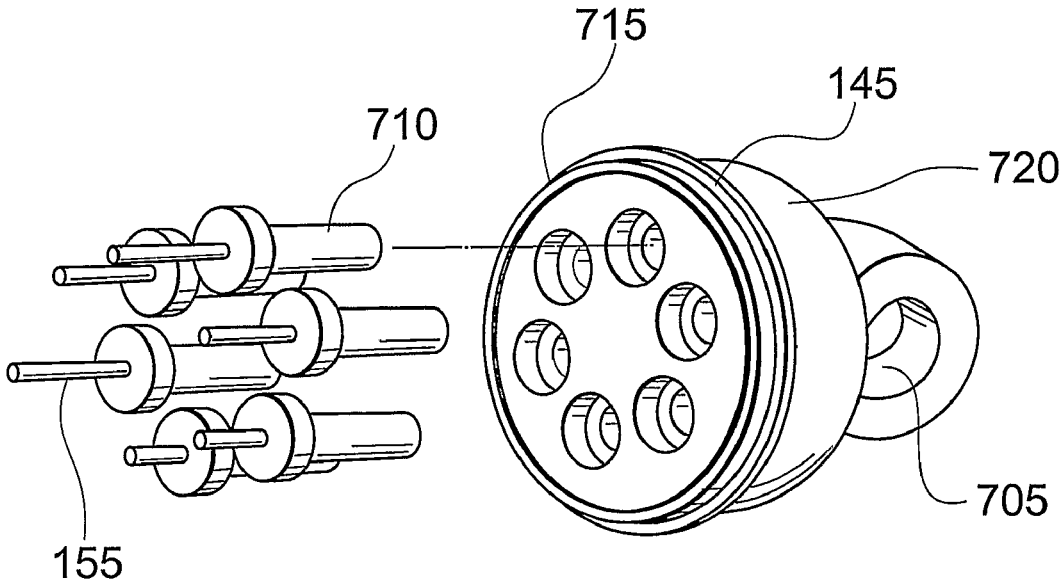
FIG. 7A is a schematic diagram illustrating a perspective view of an inside detachable key.

Referring to FIG. 7A, there is a schematic diagram illustrating a perspective view of an embodiment of the inside detachable key 140 detached from the lock cylinder. Note that the embodiment shown here is different from the embodiment shown in FIG. 1. The key 140 includes a hole 705 for a key chain and a plurality of key combination pins 155 extending from an end of the key 140. The pins 155 may be connected to segments 710 that are secured in a receptacle 715 that fits inside a covering 720. The segments 710 can be marked with a given pin length and thus enable simple reworking of key combinations through replacement of the segments 710.

The detachable key 140 provides added convenience and safety by enabling the lock cylinder to be fixed in a locked or unlocked configuration when the key 140 is secured to the cylinder using the key nut 150. Numerous people have been killed by smoke or fire while trapped at dead-bolted doors because a key had been removed from an inside lock. The key nut 150 enables the detachable key 140 of the present invention to be secured to the lock cylinder so that the lock cylinder can be easily unlocked at any time. Some prior art dead-bolt locks encourage home owners to simply leave the inside key in the lock; however that practice is more dangerous than use of the present key nut 150 because prior art keys can easily fall out of a lock and be lost during for example movement of a door. The present key nut 150 ensures that the key 140 can be securely attached to the lock cylinder. Of course the key 140 is also easily detached from the cylinder when a user requires additional security such as when locked premises are left unoccupied.

Those skilled in the art will appreciate that various alternative embodiments of the detachable key 140 are within the scope of the present invention, including alternative means of attaching the key 140 to the cylinder 100, and means for incorporating the key nut 150 into the key 140.

Further, those skilled in the art will appreciate that when the detachable key 140 is attached to the lock cylinder 100, the tips of the combination pins 155 reside in the micro pinholes 205, but the cylinder 100 can remain in a locked configuration. That is because the nut 150 can be designed to leave the key 140 unseated in the cylinder 100; thus requiring the lock to be pushed "home", against the force of the spring 160, to unlock the cylinder 100. Consider for example that insurance companies frequently define a dead-bolt as a lock bolt that resists axial movement when force is applied axially to an end of the dead-bolt. The dead-bolt 610 according to the present invention, as shown in FIG. 6, satisfies that definition when the key 140 is removed from the cylinder 100 or left in an unseated position as described above. That is because if axial force is applied to the left end of the bolt 610 shown in FIG. 6, attempting to push the bolt 610 into the housing 615, the rack teeth 635 will bind against the pinion teeth 195 and the constant length combination pins 130 will in turn bind against the combination pin cylinder 120, preventing axial movement of the bolt 610.

In an alternative embodiment of the present invention, when the key 140 is secured in the cylinder 100 the constant length combination pins 130 are aligned with the shear lines 185, 190 (as shown in FIG. 3B) and the bolt 610 is free to "float" in the bolthole 625 of the housing 615. Thus the pinion cylinders 115, 125 of the lock cylinder 100 can be unlocked but the bolt 610 may still be extended in a "locked" position. That feature of the present invention is useful in applications where a locked device may require convenient opening using axial force on a bolt 610 or other locking mechanism that engages with the pinion teeth 195.

Figure 7B:
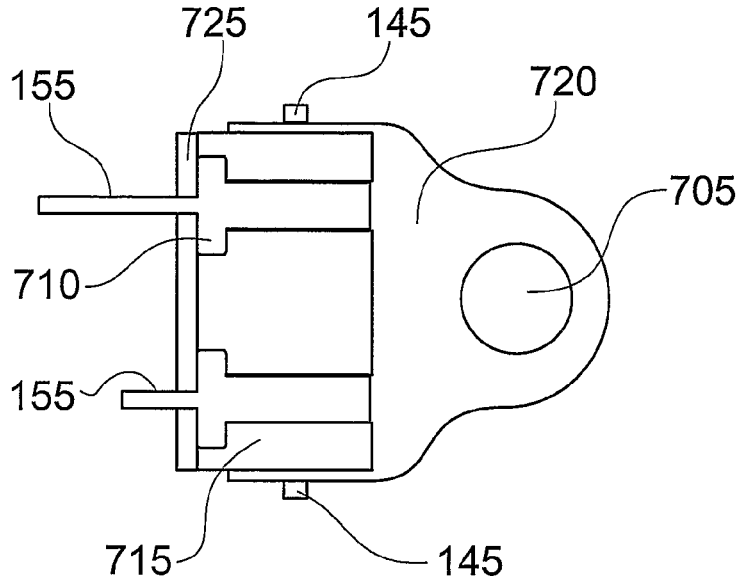
FIG. 7B is a schematic diagram illustrating a side cross-sectional view of an inside detachable key.

Referring to FIG. 7B there is a schematic diagram illustrating a side cross-sectional view of the detachable key 140, including two key combination pins 155 (the other pins 155 are not shown). In particular, FIG. 7B shows that the key combination pins 155 are generally of varying length. Note that the pin 155 shown in the top half of FIG. 7B is longer than the pin 155 shown in the bottom half of FIG. 7B. The variable length of the key combination pins 155 enable the lock cylinder to include an infinite number of combinations used to secure the cylinder. The combinations may comprise for example any number of pins 155, the pin lengths, and the positions of the pins 155 on the key 140 and their corresponding pinholes 220 on the pinion cylinders 115, 125.

FIG. 7B also illustrates a key combination disc 725, which may be used to further vary the length of the key combination pins 155. When accessing the cylinder from the outside, the detachable key 140 is entered through the anti-drill disc 110 until the key combination disc 725 contacts the anti-drill disc 110, with the key combination pins 155 extending through the disc 110. Only at that axial position of the key 140 relative to the cylinder will the constant length combination pins 130 align with the sheer lines 185, 190, allowing the pinion cylinders 115, 125 to turn. Thus if the key combination disc 725 is removed from the key 140, and the key 140 is again positioned against the disc 110, then the key combination pins 155 will be too long and the cylinder will remain locked. Using such key combination discs 725 of varying thicknesses, and correspondingly changing the length of the variable length combination pins 135, is therefore another useful technique for changing the mechanical combination required to unlock a cylinder. The key combination disc 725 may be secured to a key 140 using magnetic force or other means.

Figure 8:
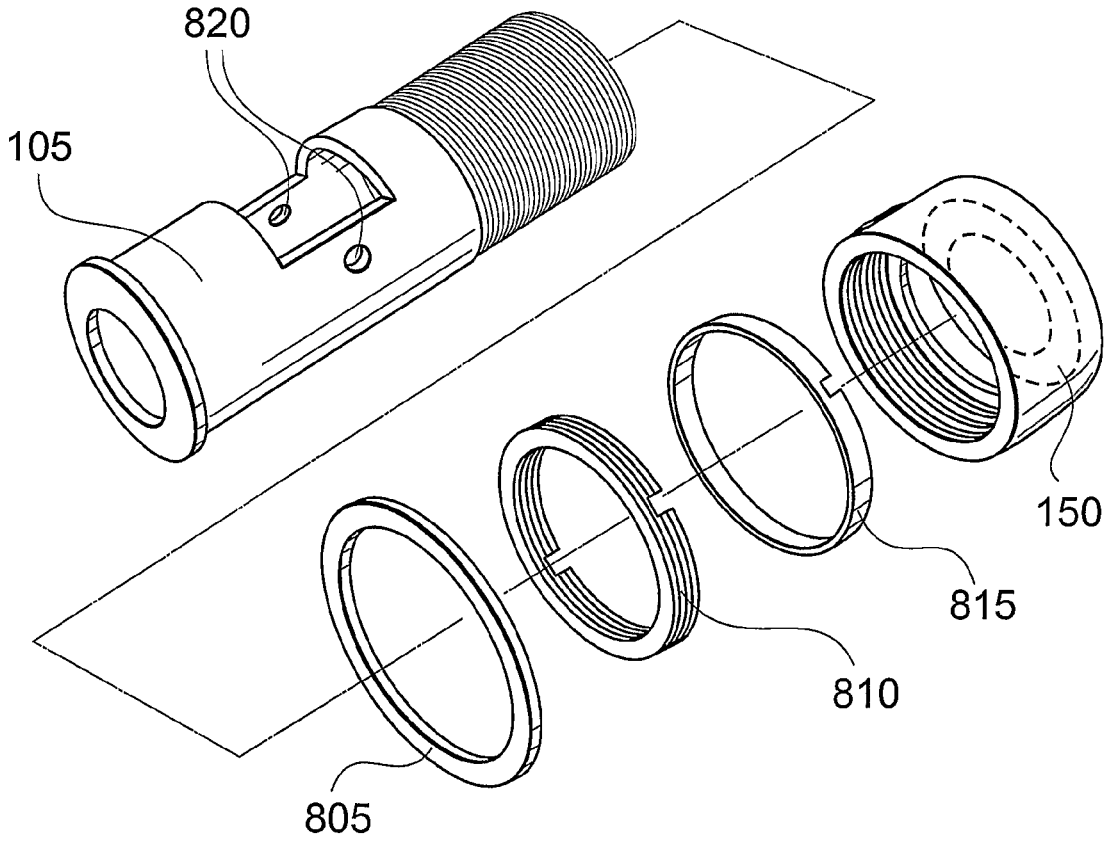
FIG. 8 is a schematic diagram illustrating an exploded perspective view of a lock cylinder housing.

Referring to FIG. 8 there is a schematic diagram illustrating an exploded perspective view of the lock cylinder housing 105. The housing 105 may be easily secured to a door for example using the washer 805, nut 810, and locking nut 815. Also shown are holes 820, one of which (depending on the orientation of the cylinder housing 105 relative to the housing assembly 600) receives the set screw 655 that is placed in hole 650 and threaded into hole 505 of the combination pin cylinder 120, thereby rigidly connecting together the combination pin cylinder 120, cylinder housing 105 and the bolt housing 615.

Those skilled in the art will recognise that the components of the present invention are preferably manufactured from high strength metals, although alternative materials can be used. For example the key 140 is preferably made of lightweight, high-strength plastic encasing high strength metal combination pins 155. The anti-drill disc 110 is preferably made of tungsten or high strength steel.

The above disclosure is intended to be illustrative and not exhaustive. The disclosure will suggest many variations and alternatives to one of ordinary skill in this art. All these alternatives and variations are intended to be included within the scope of the present claims, where the term "comprising" means "including, but not limited to". Those familiar with the art may recognize other equivalents to the specific embodiments described herein, which equivalents are also intended to be encompassed by the claims. Further, the particular features presented in the dependent claims can be combined with each other in other manners within the scope of the invention such that the invention should be recognized as also specifically directed to other embodiments having any other possible combination of the features of the dependent claims.

The invention claimed is:

1. A drill resistant lock cylinder comprising:

a cylinder housing having a central axis;

two pinion cylinders positioned inside the cylinder housing along the central axis;

a combination pin cylinder positioned along the central axis between the two pinion cylinders, wherein the combination pin cylinder and each pinion cylinder includes axial pinholes there through; and pins located inside the axial pinholes in the combination pin cylinder and the pinion cylinders, whereby two shear lines are established along axial ends of the pinion cylinders.

2. The drill resistant lock cylinder of claim 1, wherein the pins are of variable lengths, enabling a key having pins of corresponding variable lengths to be inserted at an axial end of the housing, causing the pins to align along the two shear lines and place the cylinder in an unlocked configuration.

3. The drill resistant lock cylinder of claim 1, further comprising an anti-drill disc at one end of the cylinder housing.

4. The drill resistant lock cylinder of claim 1, wherein the pinion cylinders include opposing pinion teeth designed to engage a rack for sliding a bolt in and out of a locked position.

5. The drill resistant lock cylinder of claim 1, wherein the axial pinholes are positioned equidistant from each other at a constant radius from the central axis of the housing, thereby enabling the lock cylinder to be locked in a plurality of rotational positions.

6. The drill resistant lock cylinder of claim 1, further comprising a detachable key.

7. The drill resistant lock cylinder of claim 6, wherein the detachable key includes a plurality of key combination discs of varying thicknesses for changing a mechanical combination required to unlock the lock cylinder.

8. The drill resistant lock cylinder of claim 6, wherein pins of the detachable key are connected to segments that are secured in a key receptacle.

* * * * *